United States Patent [19]

Takahashi

[11] Patent Number: 4,599,930

[45] Date of Patent: Jul. 15, 1986

[54] ELECTRONIC MUSICAL INSTRUMENT WITH TOUCH RESPONSE FUNCTION

[75] Inventor: Naoki Takahashi, Tokyo, Japan

[73] Assignee: Casio Computer Co., Ltd., Tokyo, Japan

[21] Appl. No.: 735,448

[22] Filed: May 17, 1985

[30] Foreign Application Priority Data

May 25, 1984 [JP] Japan ..... 59-104437
Jun. 9, 1984 [JP] Japan ..... 59-118843

[51] Int. Cl.[4] ..... G10H 1/46
[52] U.S. Cl. ..... 84/1.1; 84/1.17
[58] Field of Search ..... 84/1.1, 1.17, 1.27, 84/DIG. 7

[56] References Cited

U.S. PATENT DOCUMENTS 4,067,253 1/1978 Wheelwright et al. ..... 84/1.27 X
4,201,106 5/1980 Kimura et al. ..... 84/DIG. 7 X
4,211,141 7/1980 Jensen et al. ..... 84/1.27
4,362,934 12/1982 McLey ..... 84/1.27 X
4,364,296 12/1982 Franz et al. ..... 84/1.1 X
4,416,178 11/1983 Ishida ..... 84/1.1 X
4,506,581 3/1985 Sunada ..... 84/1.1
4,552,051 11/1985 Takeuchi ..... 84/1.1 X

*Primary Examiner*—William B. Perkey
*Attorney, Agent, or Firm*—Frishauf, Holtz, Goodman & Woodward

[57] ABSTRACT

First and second voltages of different levels are supplied to first and second key switches, which are consecutively turned on with the depression of a performance key on a keyboard. The output terminals of the first and second key switches are commonly connected to a common connection node, which is in turn commonly connected to input terminals of first and second buffers having different input threshold levels. A tone signal with a touch response is obtained through a response data generating circuit according to the outputs of the buffer circuits.

9 Claims, 17 Drawing Figures

BUS B
20
MASTER CLOCK GEN.
RESPONSE DATA GENERATING CIRCUIT
19
CK
11-1
11-2
11-3
11-4
11-5
11-6
11-7
11-8
IC1
IC2
IC5
IC7
IC8
IR1
IR2
IR4
IR7
IR8
VSS2
CR CIRCUIT 11
18-1
17-1
18-2
17-2
18-3
17-3
18-38
17-38
VDD
R1
C1
R2
C2
R3
C3
R38
C38
K1
K2
K3
K4
K5
K6
K75
K76
KEY SWITCH 9
K1A-1
K1B-1
K2A-1
K2B-1
K1A-2
K1B-2
K2A-2
K2B-2
K1A-3
K1B-3
K2A-3
K2B-3
K1A-38
K1B-38
K2A-38
K2B-38
161A-1
161B-1
162A-1
162B-1
161A-2
161B-2
162A-2
162B-2
161A-3
161B-3
162A-3
162B-3
161A-38
161B-38
162A-38
162B-38
LEVEL CONVERTER 15
KC1A
KC1B
KC2A
KC2B
VSS1
P
N
15-1a
15-1
15-1b
15-2a
15-2
15-2b
15-3a
15-3
15-3b
15-4a
15-4
15-4b
4
14
KC1 KC2
KEY COMMON SIGNAL GEN.
CK

| POTENTIAL / STATUS | COMMON CONNECTION NODE C OF MULTI-INPUT LOGIC CIRCUIT | OUTPUT OF BUFFER 18 | OUTPUT OF BUFFER 17 | REMARKS |
|---|---|---|---|---|
| FIRST STATUS | $V1 = V_{DD}$ | 0 | 0 | |
| SECOND STATUS | $V2 = \frac{-V_{SS2} - V_{fd}}{R_D + R_{SW2} + R_N} \cdot R_D$ | 1 | 0 | |
| THIRD STATUS | $V3 = \frac{-(V_{SS1} + V_{fd})(R_{SW2} + R_N) - (V_{SS2} + V_{fd})(V_{SW1} + R_N)}{(R_D + R_{SW1} + R_N)(R_D + R_{SW2} + R_N) - R_D}$ | 1 | 1 | |
| FOURTH STATUS | $V4 = \frac{-V_{SS2} - V_{fd}}{R_D + R_{SW2} + R_N} \cdot R_D$ | 1 | 0 | V4 = V2 |

ELECTRONIC MUSICAL INSTRUMENT WITH TOUCH RESPONSE FUNCTION

BACKGROUND OF THE INVENTION

This invention relates to an electronic musical instrument with touch response function.

An electronic musical instrument having a function of providing a touch response character to each tone generated, is disclosed in, for instance, the specification of Japanese Patent Publication No. 59-2914. In this disclosed electronic musical instrument, each key on a keyboard has a key switch which has first and second fixed contacts and a movable contact. With an on/off operation of a key, on/off data representing the on/off state of the corresponding key switch and time data indicative of whether the movable contact is moving between the first and second fixed contacts, are obtained according to a signal produced from the key switch. A touch response character is produced from the on/off data and time data thus obtained.

In the above prior art electronic musical instrument, however, the on/off data and time data of the key switch are obtained through division of a 3-level analog voltage through a resistive voltage divider in a key switch circuit. In this case, three resistors are employed for each key, and the accuracy of the analog voltage which depends on the accuracy of the resistors is low. Therefore, it is difficult to set accurate threshold values for two buffers, which are provided on the output side of the key switch and have different threshold voltages.

In addition, the individual keys are scanned one after another to obtain a touch response output for each key. Therefore, there is an upper limit on the response speed, and the accuracy of the touch data is too low to obtain a satisfactory touch response.

SUMMARY OF THE INVENTION

An object of the invention is to provide an electronic musical instrument, which can provide a satisfactory touch response with a simple construction and with a satisfactory response.

According to the invention, there is provided an electronic musical instrument with touch response function, which comprises a keyboard with a plurality of keys each having first and second key switches operable at different timings, means for supplying first and second voltage signals at different voltage levels to the first and second key switches, respectively, means for obtaining first and second key output signals based on the first and second voltage signals from the first and second key switches, and means for generating a tone signal with a touch response provided according to the first and second key output signals.

DETAILED DESCRIPTION OF THE PREFERRED EMBODIMENT

Figure 1:
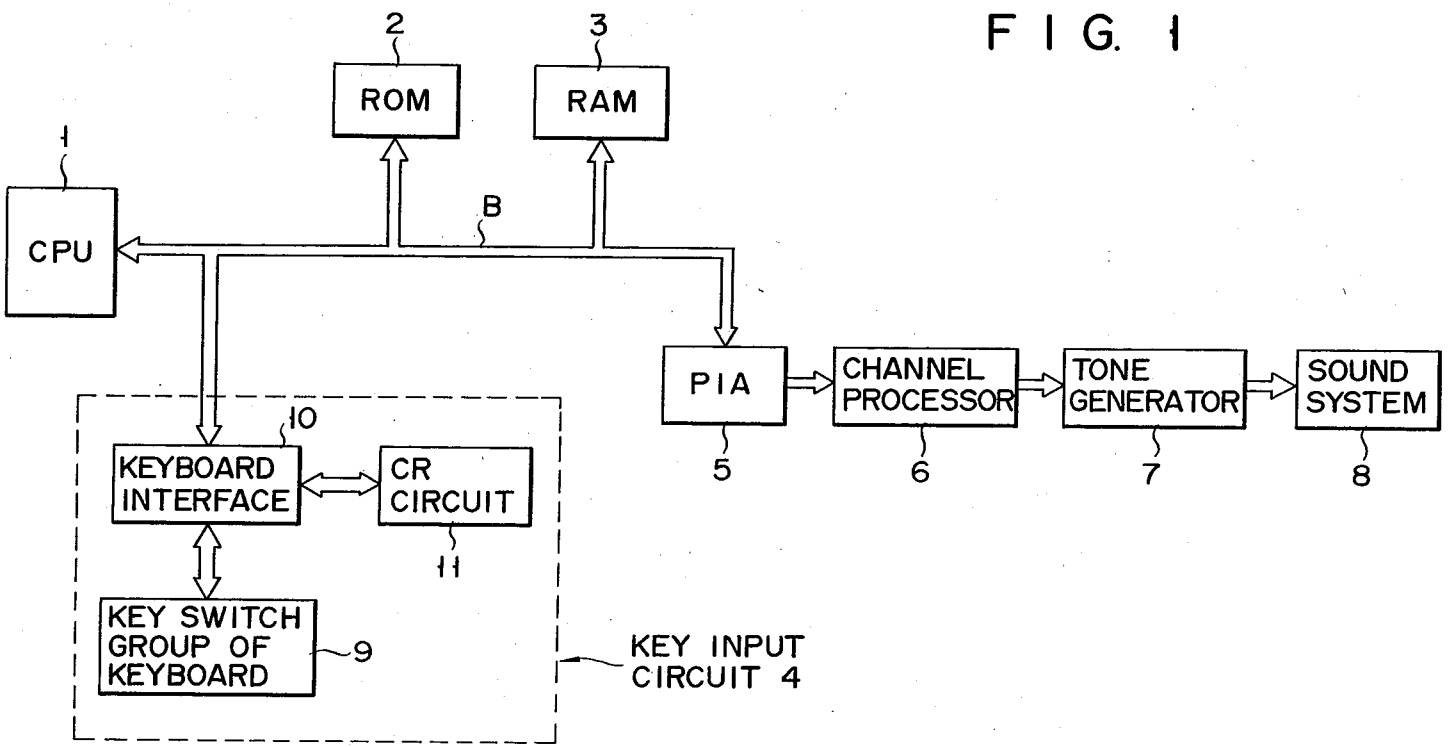
FIG. 1 is a block diagram showing an embodiment of the electronic musical instrument according to the invention.

Now, an embodiment of the invention will be described with reference to the drawings. FIG. 1 shows a block diagram of an electronic musical instrument. Referring to the Figure, reference numeral 1 designates a CPU (central processing unit). A ROM (read only memory) 2, a RAM (random access memory) 3, a key input circuit 4 and a PIA (peripheral interface adopter) 5 are connected to the CPU 1 via a bus line B. The output side of the PIA 5 is connected through a channel processor 6, a tone generator 7 and a sound system 8.

The CPU 1 controls various operations of the electronic musical instrument such as arithmetic and logic operations according to a control program stored in the ROM 2. In the RAM 3 are temporarily stored key data being processed, i.e., on/off data, key number data and initial data.

The key input circuit 4 is composed of a key switch group 9 of the keyboard, a keyboard interface 10 and a CR circuit 11. The keyboard interface 10 generates key signals for the key scanning of the key switch group 9. In addition, when a key is depressed, it controls the CR circuit 11 for producing key data necessary to obtain a touch response. The key data produced by the interrupt operation of the CPU 1 is fed to the PIA 5.

The PIA 5 permits transfer of data between the circuits 1 to 4 on one hand and the channel processor 6 on the other hand. It has 8-bit bilateral data bus and address bus (control bus).

The channel processor 6 executes an operation of allotting the key data supplied through the PIA 5 to tone generating systems of 8 channels in the tone generator 7 on a time division basis, for instance. In the tone generator 7, the tone generating system, to which the key data is allotted, produces a pertinent tone signal, which is fed to the sound system 8 to be sounded as a tone with a touch response from the loudspeaker.

The key input circuit 4 will now be described in detail with reference to FIG. 2. While the key input circuit 4 is composed of the key switch group 9 of the keyboard, keyboard interface 10 and CR circuit 11 as noted above, the keyboard interface 10 is constituted by the circuit shown in FIG. 2 excluding the circuits 9 and 11.

Figure 3:
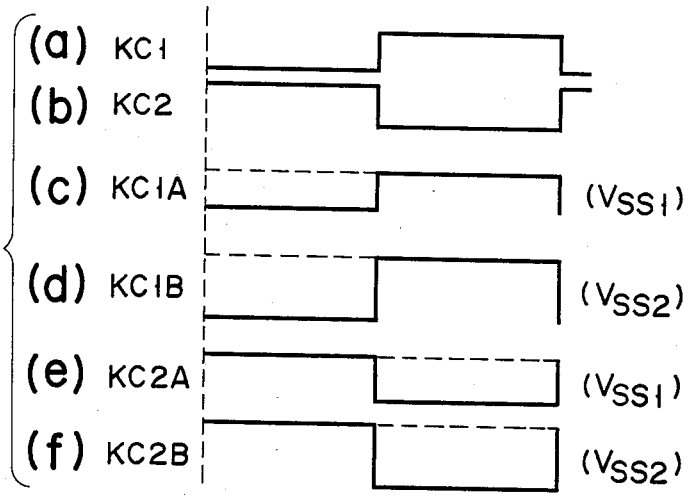
FIG. 3 is a voltage waveform diagram for explaining the operation of a level converter shown in FIG. 2.

A key common signal generator 14 generates key common signals KC1 and KC2 in opposite phase relation to each other as shown in (a) and (b) in FIG. 3, these signals KC1 and KC2 being fed to a level converter 15. The level converter 15 comprises four gate circuits 15-1 to 15-4 individually having respective P-channel MOS FETs 15-1*a* to 15-4*a* and N-channel MOS FETs 15-1*b* to 15-4*b*. These MOS FETs have their gate and source connected together. A voltage $V_{DD}$ is applied to the drain of the MOS FETs 15-1*a* to 15-4*a*, a voltage $V_{SS1}$ (−3 V) is applied to the drain of the MOS FETs 15-1*b* and 15-3*b*, and a voltage $V_{SS2}$ (−5 V) is applied to the drain of the MOS FETs 15-2*b* and 15-4*b*. The key common signal KC1 is applied to the gate circuits 15-1 and 15-2, while the other key common signal KC2 is applied to the other gate circuits 15-3 and 15-4. The individual gate circuits 15-1 to 15-4 provide respective output signals KC1A, KC1B, KC2A and KC2B having different waveforms and voltage levels as shown in (c) to (f) in FIG. 3. These output signals KC1A, KC1B, KC2A and KC2B are fed to the key switch group 9 through diodes 161A-1 and 161A-38 and 161B-1 to 161B-38.

The key switch group 9 is connected to a total of 76 keys on the keyboard. The keys are individually provided with two keys K1A-1 and K1B-1, K2A-1 and K2B-1, . . . , K2A-38 and K2B-38. The signals KC1A, KC1B, KC2A and KC2B noted above, are fed to the key switches connected to lines K1A, K1B, K2A and K2B through corresponding diodes. The output terminals of the first and second keys K1 and K2, those of the third and fourth keys K3 and K4, . . . , those of the seventy fifth and seventy sixth keys K75 and L76, are commonly connected to respective common connection nodes C1, C2, . . . , C38. Voltage $V_{DD}$ is applied to the individual common connection nodes C1, C2, . . . , C38 through respective resistors R1, R2, and . . . , R38. The common connection nodes C1, C2, . . . , C38 are also connected to a response data generating circuit 19 to be described later through respective two buffers 17-1 and 18-1, 17-2 and 17-2, . . . , 17-38 and 17-38, the pair buffers having different threshold levels. The combinations of elements R1, 17-1 and 18-1, elements R2, 17-2 and 18-2, . . . , elements R38, 17-38 and 18-38 are referred to as multi-input logic circuits, respectively.

The response data generating circuit 19 includes a circuit, which receives the data from the multi-input logic circuits and produces and stores the data necessary for providing touch response through control of elements IC1 to IC8 and IR1 to IR8 in the CR circuit 11, and an input/output port, through which the key data noted above is transferred to the PIA 5 through the bus line B according to an interrupt signal produced from the CPU 1 after key data has been stored in the circuit noted above. The circuit 19 will be described later in detail. A master clock generator 20 connected to the circuit 19 provides various timing signals thereto. A timing signal provided from a terminal CK of the response data generating circuit 19 is fed to the key common signal generator 14.

The CR circuit 11 has 8 CR charge/discharge circuits consisting of respective elements IC1 and IR1, IC2 and IR2, . . . , IC8 and IR8 for the respective tone generating systems of 8 channels, and is used for producing initial data constituting the key data noted above.

Figure 4A:
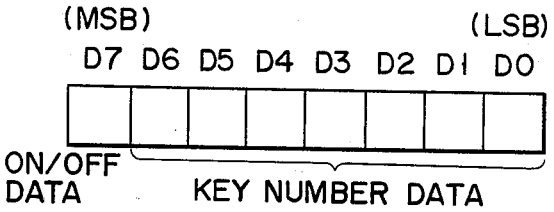
FIGS. 4A and 4B are data format diagrams.
Figure 4B:
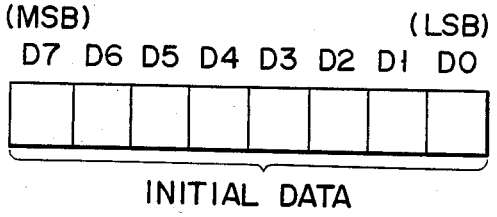

FIGS. 4A and 4B show the configuration of the key data produced in the response data generating circuit 19. More specifically, 8-bit data consisting of MSB on/-off data and 7-bit key number data, and FIG. 4B shows 8-bit initial data.

Figures 5, 15:
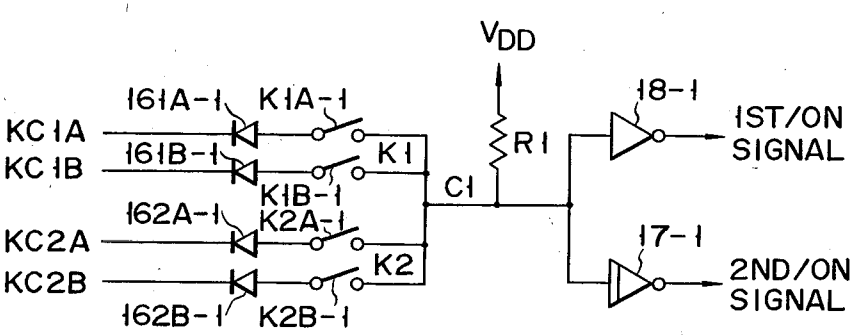
FIG. 5 is an equivalent circuit diagram of key switches and a multi-input logic circuit as part of the circuit shown in FIG. 2.
FIG. 15 is a table showing various status of a key block in the operation thereof.

FIG. 5 shows a circuit including the diodes 161A-1, 161B-1, 162A-1 and 162B-1, key switches K1A-1, K1B-1, K2A-1 and K2B-1, common connection node C1 and multi-input logic circuit of elements R1, 17-1 and 18-1 only, the circuit corresponding to the first and second keys K1 and K2. Identical circuits are also provided for the other key pairs. The outputs of the buffers 18-1 and 17-1 are referred to as 1st/on and 2nd/on signals, respectively.

A specific circuit construction of the response data generating circuit 19 will now be described with reference to FIGS. 6 to 9.

Figure 6:
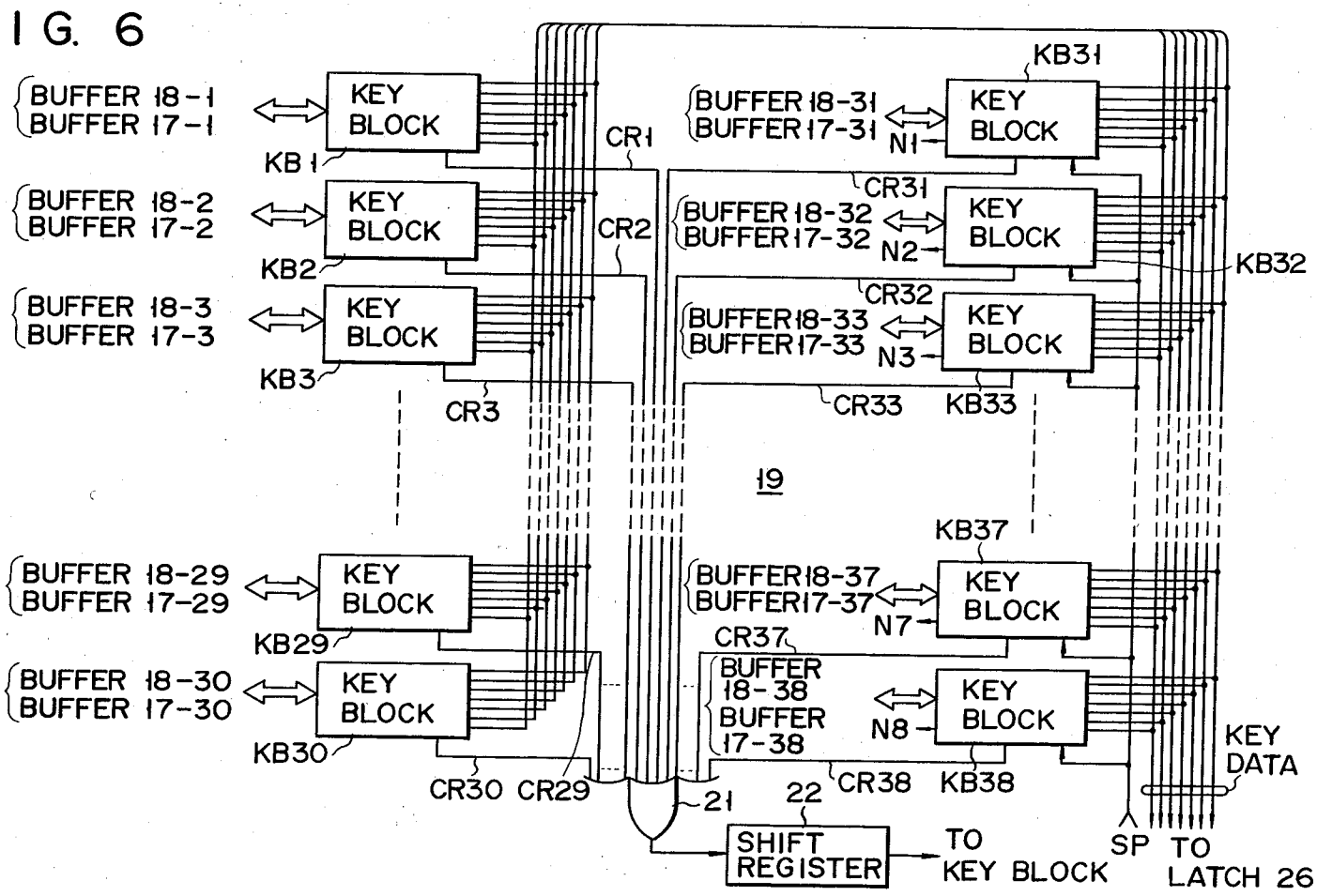
FIG. 6 is a schematic representation of a response data generating circuit.

Referring to FIG. 6, 38 key blocks K1 to K38 are connected to the buffers 17-1 to 17-38 and 18-1 and 18-38 and constitute part of the response data generating circuit 19. These key blocks have an identical circuit construction except for a gate structure of some of them. Their detailed circuit construction will be described later in detail with reference to FIG. 8. The numerals 1 to 38 in the reference symbols KB1 to KB38 of the key blocks correspond to like numerals provided for the key pairs K1, K2 to K75, K76 in the key switch group shown in FIG. 2.

This embodiment of the electronic musical instrument, which has 76 keys as noted above, has a key split function of splitting the function of keys on the keyboard into a lower octave key group consisting of 16 keys corresponding to the key blocks KB31 to KB38 and an upper octave key group consisting of 60 keys corresponding to the key blocks KB1 to KB30. A key split switch (not shown), accordingly, is provided in the key switch group 9. When the key split switch is operated, different timbres can be generated from the lower and upper octave key groups. Particularly, this embodiment features that the same number of different tones can be simultaneously produced from the upper octave key group before and after the performance of the keyboard split. Since the embodiment of the musical instrument is an 8-tone polyphonic instrument based on a time division basis, 8 different tones at the most may be simultaneously produced from the lower octave key group or melody key group both before and after the performance of the keyboard split.

Meanwhile, in the keyboard split mode the 16-key lower octave key group is used to produce an accompaniment rhythm or the like. For this reason, the key blocks KB31 to KB38 are given a split signal SP, which is at "1" level in the keyboard split mode and at "0" level otherwise. Of course, this lower octave key group may be used for ordinary melody performance keys when the keyboard split mode is not set.

Figure 2:
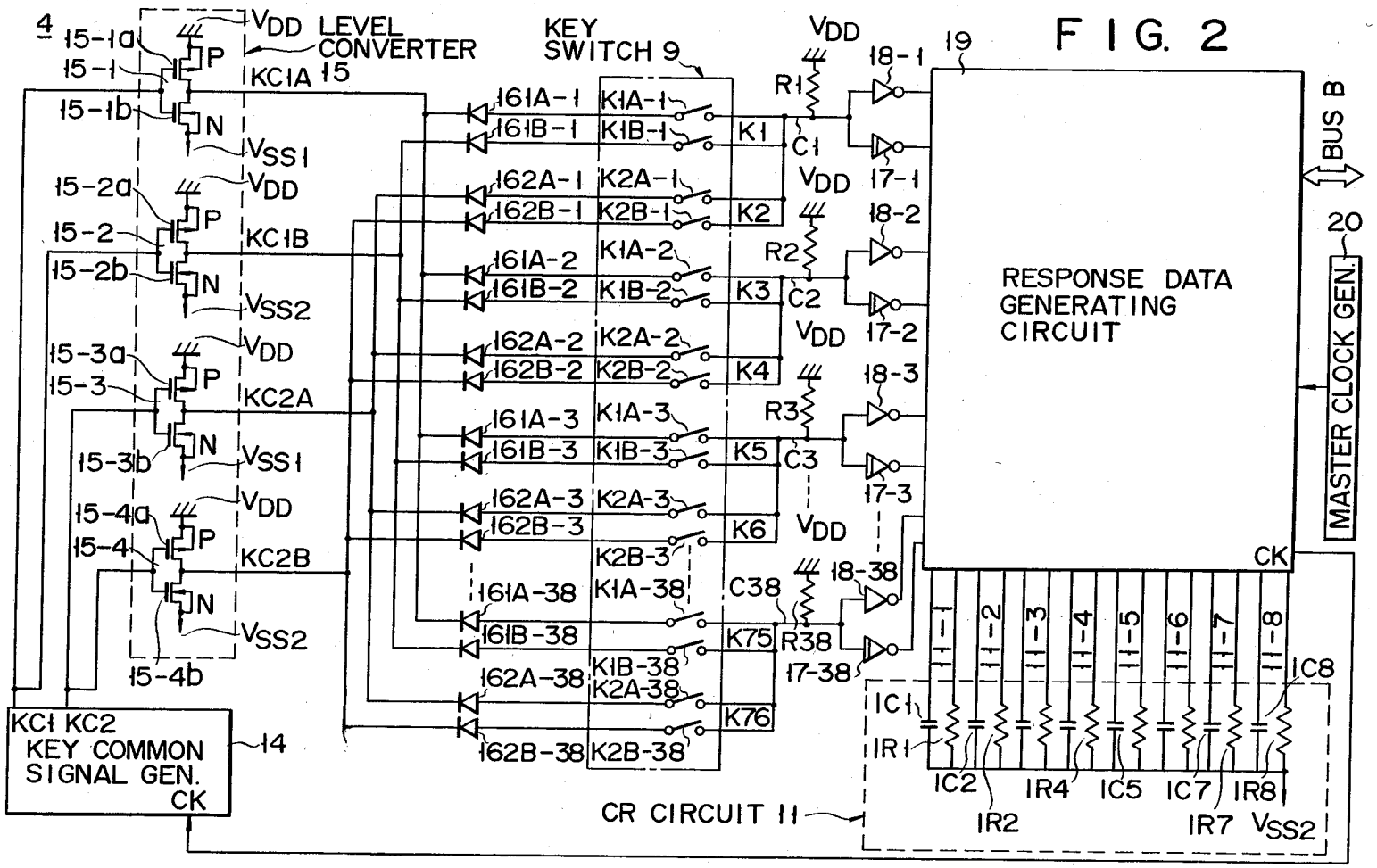
FIG. 2 is a schematic representation of a key input circuit shown in FIG. 1.

Referring to FIG. 6, the outputs of the buffers 18-1 and 17-1, 18-2 and 17-2, . . . , 18-30 and 17-30 shown in FIG. 2 are fed to the key blocks KB1 to KB30, and resultant key data that are detected in a manner to be described later are fed as 7-bit data to a latch (to be described later) shown in FIG. 7. The key blocks KB1 to KB30 also provide respective signals CR1 to CR30 which represent the timings of use of the CR charge/-discharge circuits in the CR circuit 11 allotted to the key blocks, the signals CR1 to CR30 being fed through an OR gate 21 to an 8-bit shift register 22.

Key number to be described layer, giving the key data, is common to the key switches of two keys contained in each key block, but the distinction of the key data for the two key switches is done according to the signals KC1A and KC1B and signals KC2A and KC2B having different voltage levels.

Meanwhile, the outputs of the buffers 18-31 and 17-31, 18-32 and 17-32, . . . , 18-38 and 17-38 shown in FIG. 2 are fed to the key blocks KB31 to KB38, respectively. These key blocks feed their key number data to the latch shown in FIG. 7. Also, they provide CR charge/discharge circuit allotment timing signals CR31 to CR38 which are fed through the OR gate 21 to the shift register 22. Further, in the keyboard split mode the key blocks KB31 to KB38 provide accompaniment key number data N (N1 to N8) fed to a different latch (to be described later) shown in FIG. 7.

Figure 7:
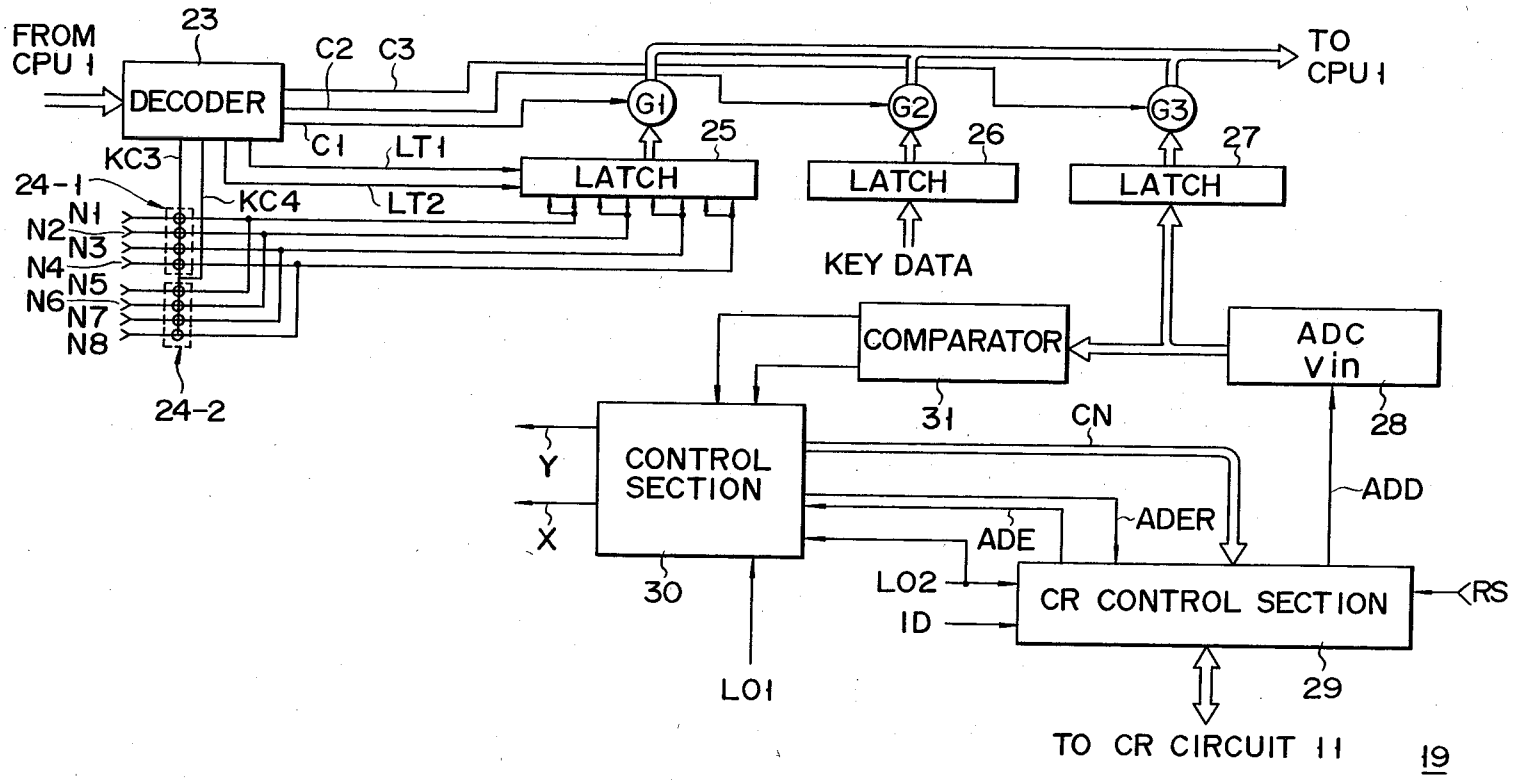
FIG. 7 is a block diagram showing part of the response data generating circuit.

FIG. 7 shows a portion of the response data generating circuit 19 other than the circuit shown in FIG. 6. Referring to FIG. 7, reference numeral 23 designates a decoder, which is supplied with various control data from the CPU 1 and generates signals C1 to C3, KC3 and KC4, LT1 and LT2 according to these control data. The signals C1 to C3 are fed as gate control signals to respective gates G1 to G3. The signals KC3 and KC4 are fed as gate control signals to respective gate groups 24-1 and 24-2 each consisting of four transfer gates. The signal KC3 has double the period of the signals KC1 and KC2, and the signal KC4 is an opposite phase signal to the signal KC3.

The signals LT1 and LT2 correspond to the signals KC1 and KC2, respectively.

Data N1 to N4 or N5 to N8 is coupled through the gate group 24-1 or 24-2 to be latched in a latch 25 and thence fed through the gate G1 to the CPU 1.

The key data from the key blocks KB1 to KB38 is latched in a latch 26 and thence fed through the gate G2 to the CPU 1. An A/D converter 28 feeds touch response data representing key depression speed, which is latched as initial data in a latch 27 and thence fed through the gate G3 to the CPU 1.

A CR control section 29 contols the charging and discharging operations of the RC charge/discharge circuits of the CR circuit 11. It is initialized by a reset signal RS which is produced from the CPU 1 when a power source switch is turned on. It is further supplied from a control section 30 with CR number designation data CN for scanning the eight CR charge/discharge circuits and also with data ADER. It is further supplied from the key blocks with data LO1 and ID. The CR control section 29 feeds data AD0 to the A/D converter 28 and also feeds data ADE and LO2 to the control section 30.

In addition to the control of the operation of the CR circuit 11, the control section 30 also controls the operation of a comparator 31, to which A/D conversion output data of the A/D converter 28 is fed. The comparator 31 judges the content of the A/D conversion output data and feeds result data to the control section 30. In consequence, the control section 30 feeds either signal X or Y to the key blocks KB1 to KB38.

Figure 8:
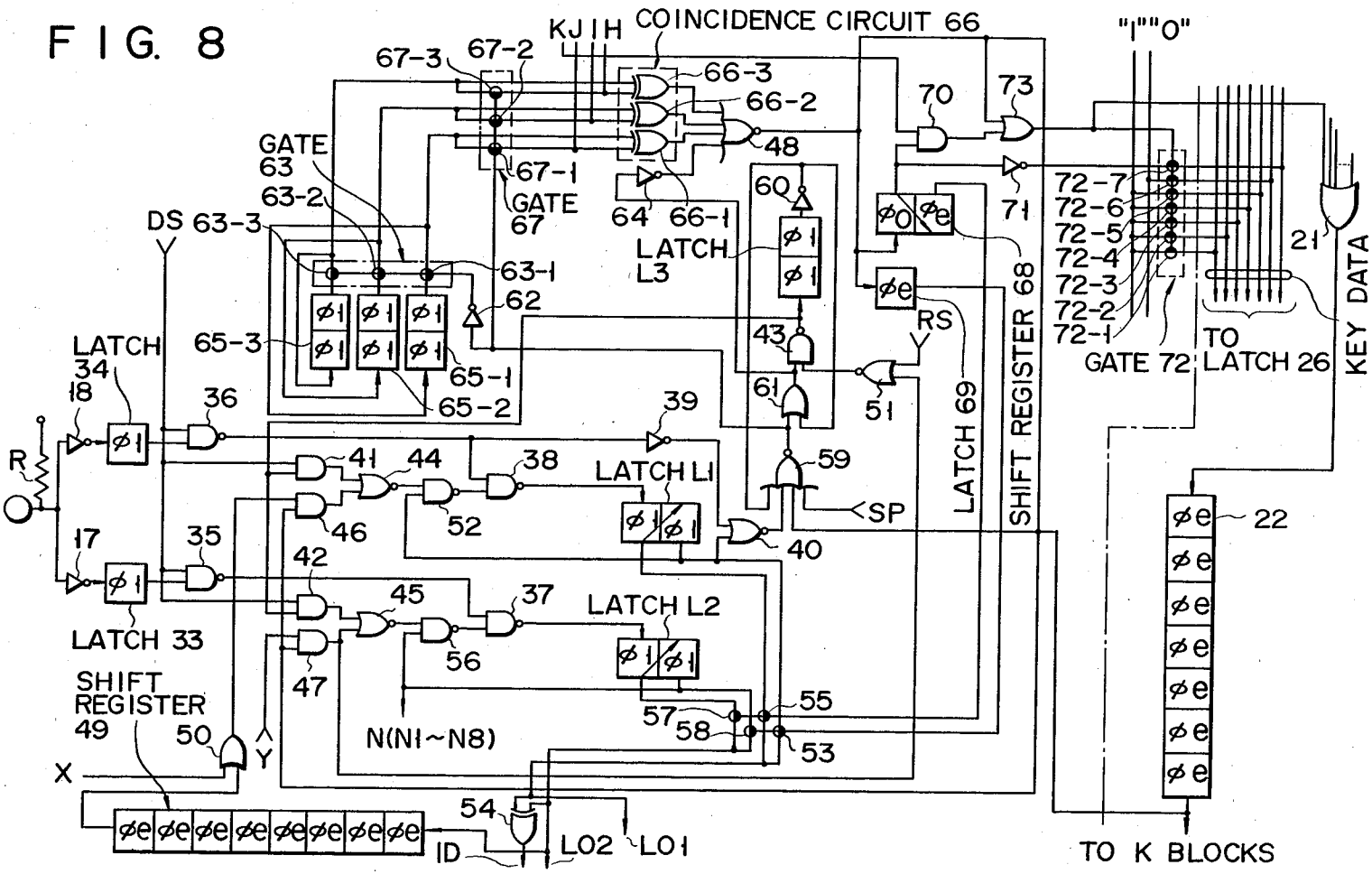
FIG. 8 is a schematic of a key block.

The specific circuit construction of the key blocks KB1 to KB38 will now be described with reference to FIG. 8. The circuit of FIG. 8 represents one of the key blocks KB1 to KB38, which have an identical structure except for a gate structure concerning key number data.

Referring to the Figure, buffers 17 and 18 represent those of one of the pairs of buffers 17-1 and 18-1, 17-2 and 18-2, . . . , 17-38 and 18-38 of the key blocks shown in FIG. 2. Likewise, a resistor R represents one of the resistors R1 to R38. The outputs of the buffers 17 and 18 are latched in respective latches 33 and 34, which are operated under the control of a basic clock $\phi$1. The outputs of the latches 33 and 34 are fed to respective NAND gates 35 and 36, to which is also fed a timing distinguishment clock DS (see FIG. 10). The output of the NAND gate 35 is fed to a NAND gate 37, and the output of the NAND gate 36 is fed to a NAND gate 38 and also fed through an inverter 39 to a NOR gate 49.

The clock DS noted above is also fed to AND gates 41 and 42, to which is also fed the output of a NAND gate 43 to be described later. The outputs of the AND gates 41 and 42 are fed to respective NOR gates 44 and 45.

A NOR gate 48 provides a signal at "1" level at each channel timing, to which each key block is allotted. This output of the NOR gate 48 is fed to AND gates 46 and 47. To the AND gate 46 is also fed the output of an OR gate 50, to which are fed the output of an 8-bit shift register 49 and the signal X noted above. To the AND gate 47 is also fed the signal Y noted above. The output of the AND gate 46 is fed to the NOR gate 44. The output of the AND gate 47 is fed to the NOR gate 45 and also fed along with the reset signal RS noted above to a NOR gate 51. The output of the NOR gate 51 is fed to the NAND gate 43.

The output of the NOR gate 44 is fed to a NAND gate 52, the output of which is in turn fed to the NAND gate 38. The output of the NAND gate 38 is fed to a latch L1, which consists of a 2-bit shift register. Thus, an "on" signals from the key switches K1A and K1B, produced in response to the key operation, is latched in the latch L1. The 2nd bit output of the latch L1 is fed to the other input terminal of the NAND gate 52 and also to the other input terminal of the NOR gate 40. Further, it is fed through a transfer gate 53 to be fed as signal LO1 to the control section 30. Still further, it is fed to an exclusive OR gate 54. The latch L1 is operated under the control of the basic clock $\phi$1, and its 2nd and 1st bit outputs represent the first and second half timings, respectively. The 1st bit output of the latch L1 is fed through a transfer gate 55 to befed out as signal LO1, and is also fed to the exclusive OR gate 54.

The output of the NOR gate 45 is fed to an AND gate 56, the output of which is in turn fed to the NAND gate 37. The output of the NAND gate 37 is fed to a latch L2, which consists of a 2-bit shift register operated under the control of the clock $\phi$1. Thus, an "on" signal of the key switches L1B and L2B, produced with the key operation, is latched in the latch L2. The 1st bit output of the latch L2 is fed through a transfer gate 57 to the exclusive OR gate 54, and is also fed as signal LO2 to the CR control section 29 and control section 30. Further, it is fed to the shift register 49. The 2nd bit output of the latch L2 is fed as the signal N noted above, and is also fed through a transfer gate 58 to be fed as signal LO2 and also be fed to the exclusive OR gate 54. The output of the exclusive OR gate 54 is fed as the signal ID noted above to the CR control section 29.

The shift register 49 is driven under the control of a clock $\phi$e which represents the second half timing.

The output of the NOR gate 40 is fed to a NOR gate 59. To the NOR gate 59 are also fed the split signal SP, output of the NOR gate 48 and output of an inverter 60, to which is fed the output of a latch L3. The output of the NOR gate 59 is fed through an OR gate 61 to the other input terminal of the NAND gate 43. It is also fed through an inverter to be fed as gate control signal to a gate group 63 consisting of three transfer gates 63-1 to 63-3.

The output of the NAND gate 43 is fed to the other input terminal of the AND gates 41 and 42, and is also latched in the latch L3. The latch L3 is operated under the control of the basic clock $\phi$1, and usually a "1"

signal is latched in it. The output of the latch L3 is circulated through the inverter 60 and OR gate 61. The output of the OR gate 61 is fed through an inverter 64 to an input terminal of the NOR gate 48 noted above.

The outputs of the transfer gates 63-1 to 63-3 of the gate group 63 are circulated through respective 2-bit shift registers 65-1 to 65-3 back to the transfer gates 63-1 to 63-3. The circulating circuit, consisting of the shift registers 65-1 to 65-3 and gate group 63, serves to hold number data for the allotment of the CR charge/discharge circuit to the operated key, i.e., data in a one-to-one correspondence to the tone generation channels.

The outputs of the transfer gates 63-1 to 63-3 of the gate group 63, are also fed to one input terminal of respective exclusive OR gates 66-1 to 66-3 constituting a coincidence circuit 66. Further, they are fed through transfer gates 67-1 to 67-3 of a gate group 67 to the other input terminal of the exclusive OR gates 66-1 to 66-3. To the other input terminal of the exclusive OR gates 66-1 to 66-3 are fed timing signals J, I and H (see FIG. 12) from the CPU 1, respectively. When the allotment number data fed from the gate group 63 coincides with one of channel timings 0 to 7 based on the timing signals J, I and H, the coincidence circuit 66 consisting of the exclusive OR gates 66-1 to 66-3 produces a coincidence signal which is fed to the NOR gate 48. The transfer gates 67-1 to 67-4 of the gate group 67 are gate-controlled by the output of the NOR gate 59.

The output of the NOR gate 48 is further fed a 2-bit shift register 68 and also to a latch 69. The 1st bit of the shift register 68 is operated under the control of the basic clock $\phi 0$ generated at the first half timing, while the 2nd bit is operated under the control of the basic clock $\phi e$ generated at the second half timing. The latch 69 is operated under the control of the basic clock $\phi e$. The output of the 1st bit of the shift register 68 is fed to one input terminal of the AND gate 70, and is also fed through an inverter 71 to a transfer gate 72-7 in a gate group 72. The 2nd output of the shift register 68 is fed as gate control signal to the the gates of the transfer gates 55 and 57. The output of the latch 69 is fed as gate control signal to the gates of the transfer gates 53 and 58.

Control signal K (see FIG. 12) is fed from the CPU 1 to the other input terminal of the AND gate 70. The output of the AND gate 70 is fed through an OR gate 73 as gate control signal to the gates of transfer gates 72-1 to 72-7 of the gate group 72, and is also fed through the OR gate 21 to the shift register 22. The output of the NOR gate 48 is further fed to the OR gate 73, the output of which is in turn fed to the gate group 72 and also to the OR gate 21.

In the illustrated key block, a "1" signal is constantly fed to the transfer gates 72-1 to 72-5 of the gate group 72, while a "0" signal is constantly fed to the transfer gate 72-6.

The outputs of the transfer gates 72-6 to 72-1, in this case, represent key number data of the operated key; in this example the data is "011111" or decimal "31", while the output of the remaining transfer gate 72-7 is MSB (most significant bit) data giving a sign "0" (first half) or "1" (second half) to the key number data. Since the keys on the keyboard are arranged as pairs of keys, the CPU 1 provides key data of each key from a common key number to pair keys according to the MSB sign data, i.e., first and second data output timings.

The key number data provided from the gate group 72 is decimal "31" in this example as noted above. However, the key numbers of the 38 key blocks are of course different from one another; for instance key numbers "1", "2", . . . , "38" are set for the respective key blocks KB1, KB2, . . . , KB38. That is, key number data "1", "2", . . . , "38" are provided from the lower 6-bit transfer gates 72-6 to 72-1 of the gate group 72 of the respective key blocks KB1, KB2, . . . , KB38. The first and second half data "0" and "1" are accordingly constantly fed to selected ones of these transfer gates 72-6 to 72-1. With the sign bit noted above, two different key number data are obtained from each of the key numbers "1" to "38", which are each common to two keys of each of the key blocks KB1 to KB38. The output data of the transfer gates 72-7 to 72-1 of the gate group 72 is fed to the latch 26 (FIG. 7).

Figure 9A:
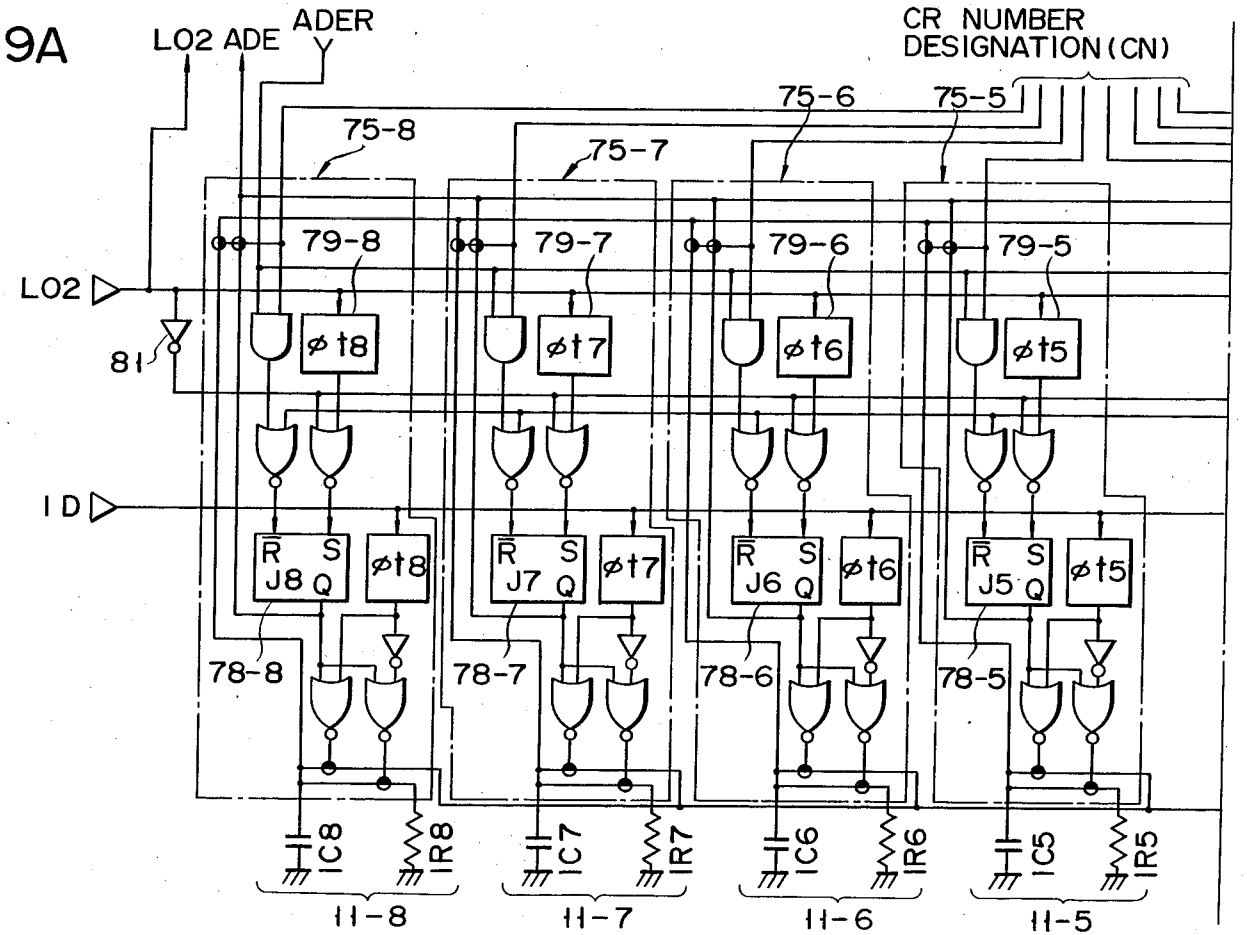
FIGS. 9A and 9B are in combination a schematic of a CR control section.
Figure 9B:
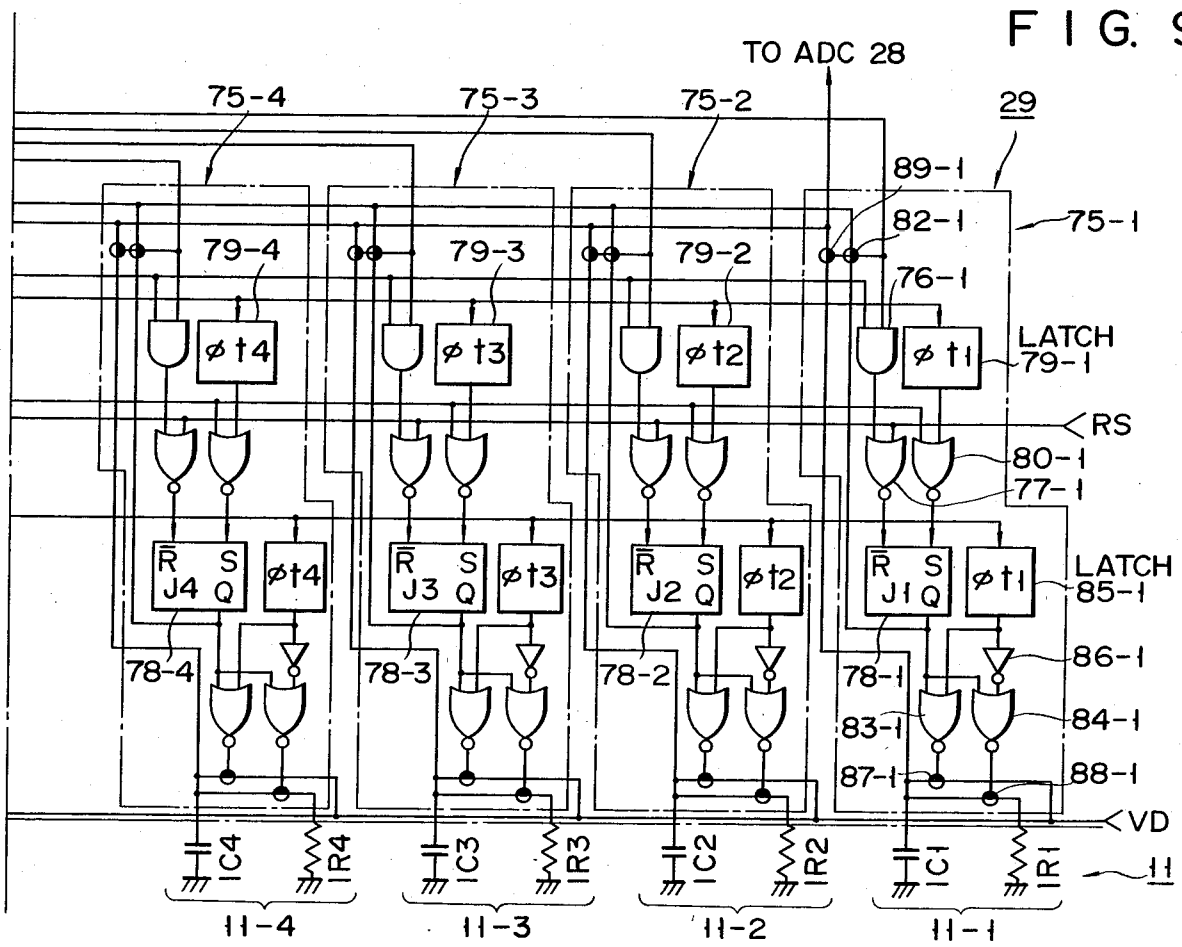

FIG. 9 shows a specific circuit construction of the CR control section 29. The eight CR charge/discharge circuits 11-1 to 11-8 of the CR circuit 11 are shown in a lower portion of FIG. 9. The CR charge/discharge circuits 11-1 to 11-8 consist of the respective combinations of capacitors and resistors IC1 and IR1, IC2 and IR2, . . . , IC8 and IR8.

The CR control section 29, as is shown, has control circuits 75-1 to 75-8 for the eight CR charge/discharge circuits 11-1 to 11-8, respectively. The control circuits 75-1 to 75-8 have an identical construction, so only the control circuit 75-1 will be typically described in detail.

The 1st bit data of the CR number designation data CN is fed to one input terminal of an AND gate 76-1 of the control circuit 75-1. The signal ADER noted above is fed to the other input terminal of the AND gate 76-1, and the output thereof is fed to one input terminal of the NOR gate 77-1. The reset signal RS is fed to the other input terminal of the NOR gate 77-1, and the output thereof is fed to a reset input terminal of an S-R flip-flop 78-1. The flip-flop 78-1 is operated by a timing signal J1 (see FIG. 12).

Figure 12:
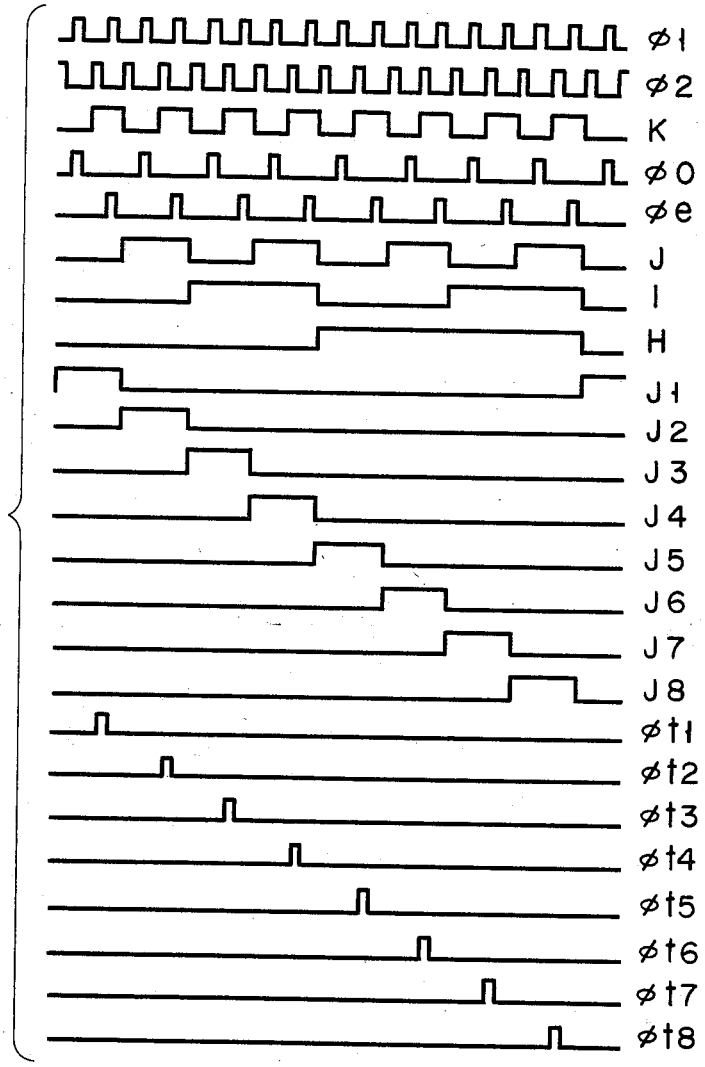
FIG. 12 is a time chart showing various timing signals.

The signal LO2 noted above is fed to a latch 79-1, which is operated by a timing signal $\phi t1$ (see FIG. 12). The output of the latch 79-1 is fed to one input terminal of a NOR gate 80-1. The signal LO2 is fed through an inverter 81 to the other input terminal of the NOR gate 80-1. The output of the NOR gate 80-1 is fed to a set input terminal S of the flip-flop 78-1. The set output of the flip-flop 78-1 is fed through a transfer gate 82-1 to be fed as signal ADE to the control section 30, and is also fed to one input terminal of each of NOR gates 83-1 and 84-1.

The signal ID noted above is fed to a latch 85-1, which is operated by the timing signal $\phi t1$. The output of the latch 85-1 is fed through an inverter 86-1 to the other input terminal of each of the NOR gates 83-1 and 84-1. The output of the NOR gate 83-1 is fed to the gate of a transfer gate 87-1, while the output of the NOR gate 84-1 is fed to the gate of a transfer gate 88-1. A voltage VD is fed to the transfer gates 87-1 and 88-1 to be applied to the capacitor IC1 and resistor IR1. The output of the CR charge/discharge circuit 11-1 consisting of the capacitor IC1 and resistor IR1, is fed through a transfer gate 89-1 to the A/D converter 28. The transfer gates 82-1 and 89-1 are gate-controlled by the 1st bit data of the CR number designation data CN.

The remaining control circuits 75-2 and 75-8 have the same construction as the control circuit 75-1, but the 2nd to 8th bit data of the CR number designation data CN are fed to them, respectively. The timing signals $\phi t2$ to $\phi t8$ for operating the latches 79-2 to 79-8 are provided at different timings as shown in FIG. 12. Also, the timing signals J2 to J8 for operating the flip-flops 78-2 to 78-8 are provided at different timings as shown in FIG. 12.

Figure 10:
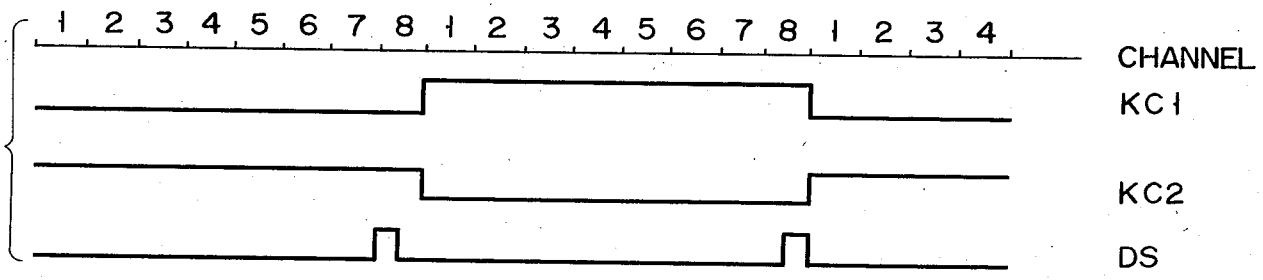
FIG. 10 is a time chart showing the relation between key common signals and channels.

The operation of the above embodiment will now be described with reference to FIGS. 1 to 13. The overall operation will first be briefly described. The key common signal generator 14 in the keyboard interface 10 provides the opposite phase key common signals KC1 and KC2 as shown in FIG. 10. The level converter 15 shown in FIG. 2 converts the signals KC1 and KC2 into the signals KC1A and KC1B and also signals KC2A and KC2B at the different voltage levels (FIG. 3) for sampling the key switches of the key switch group 9, two key switches being provided for each key. Therefore, when a key is depressed and released, a voltage at a level corresponding to the status of that key being operated appears at one of the common connection nodes C1 to C38 on the output side of the key switches of that key. As a result, the corresponding multi-input logic circuit is driven to produce a signal fed to the response data generating circuit 19. The circuit 19 receiving this signal drives the CR charge/discharge circuits 11-1 to 11-8 of the CR circuit 11, thereby producing and storing data necessary for providing a touch response, i.e., key on/off data, key number data and initial data. Then an interrupt signal is fed to the CPU 1, and the key data is fed under the control of the CPU 1 through the PIA 5 to the channel processor 6. A tone signal is thus produced with a tone generating channel allotted in the tone generator 6, and is sounded through the sound system 8 as a tone provided with a touch response effect.

Figure 11:
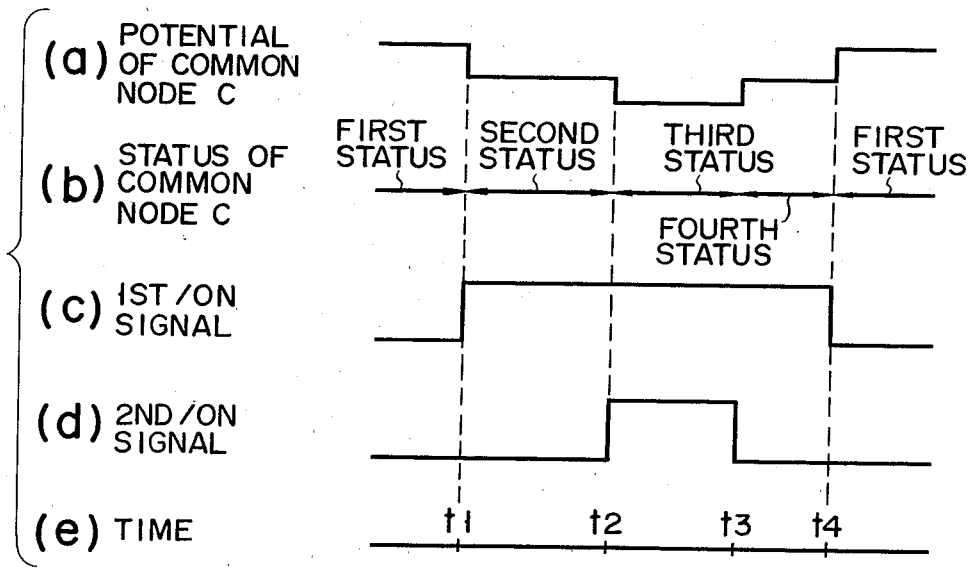
FIG. 11 is a waveform diagram for explaining the operation of a key block with a key operation.

Now, the operation will be described specifically in connection with a case when the 1st key is operated with reference to a time chart shown in FIG. 11.

Before the start of depression of the key, the key switches K1A1 and K1B1 are both "off", i.e, they are in a first status. At this time, the potential V1 on the common connection node C1 is $V_{DD}$. Further, the outputs of the buffers 18-1 and 17-1 (i.e., 1st/ON and 2nd/ON signals) are both at "0" level.

When the key is operated, the key switch K1A-1 is turned on while the key swich K1B-1 remains "off", i.e., a second status (from instant t1 in FIG. 11) sets in. In this status, the potential V2 on the common connection node C1 is $$V_2 = \frac{-V_{SS2} - V_{fd}}{R_D + R_{SW2} + R_N} \cdot RD$$

where $R_D = R_1$, $R_{SW2}$ is the resistance of the key switch K1B-1, $R_N$ is the "on" resistance of the N-channel MOS FET in the level converter 15, and $V_{fd}$ is the forward voltage across the diode 161A-1 and 161B-1.

Therefore, if the threshold voltage of the buffer 18-1 is set to be between $V_1$ and $V_2$, the outputs of the buffers 18-1 and 17-1 remain at "1" and "0" levels, respectively, the data "1" and "0" being fed to the response data generating circuit 19. As a result, the response data generating circuit 19 causes discharging of the selected one of the charge/discharge circuits in the CR circuit 11, and also obtains on/off data indicative of the "on" operation and key number data.

At a subsequent instant t2, the key switch K1B-1 is also turned on, i.e., a third status sets in. In this status, the potential $V_3$ on the common connection node C1 is $$V_3 = \frac{-(V_{SS1} + V_{fd})(R_{SW2} + R_N) - (V_{SS2} - V_{fd})(R_{SW1} + R_N)}{(R_D + R_{SW1} + R_N)(R_D + R_{SW2} + R_N) - R_D^2}$$

where $R_{SW1}$ is the resistance of the key switch K1A-1.

If the threshold voltage of the buffer 17-1 is set to be between $V_2$ and $V_3$, both the buffers 18-1 and 17-1 feed data "1" to the response data generating circuit 19. Therefore, the circuit 19 stops the discharging operation of the CR charge/discharge circuit, and then detects the amount of charge therein and converts it into the corresponding digital value to obtain the initial data. When the data obtained in the above way are stored in an internal register, the circuit 19 feeds an interrupt signal to the CPU 1. Thus, the key data consisting of the three different data noted above is transferred to the PIA 5 to start sounding of the tone with touch response.

Subsequently, when the key releasing is started at instant t3, the key switch K1B-1 is turned off while the key switch K1A-1 remains "on", i.e., a fourth status sets in, which is the same as the second status. The potential $V_4$ on the common connection node C1 is the same as the potential $V_2$ noted above, and data "1" and "0" are fed to the response data generating circuit.

When the key switch K1A-1 is subsequently also turned off so that the first status is recovered (at instant t4), the response data generating circuit 19 generates on/off data indicative of the key release operation and key number data and feeds an interrupt signal to the CPU 1. The on/off data and key number data are thus transferred to the PIA 5 so that the tone generation is stopped.

Figure 13:
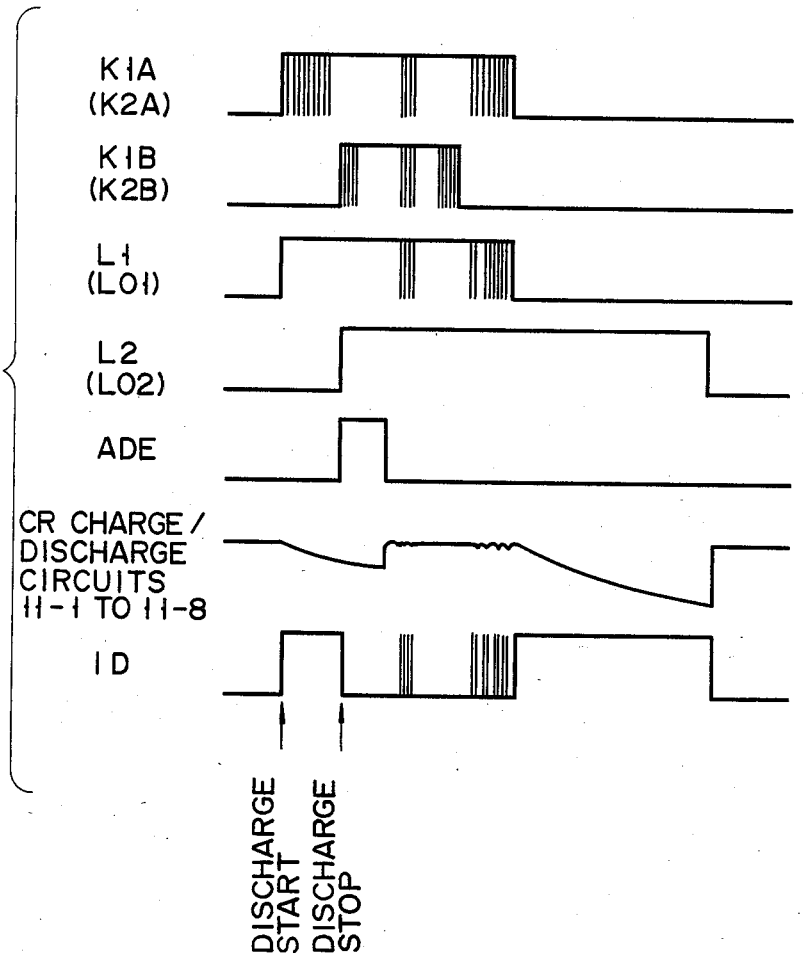
FIG. 13 is a waveform diagram for explaining a feature of the invention.

Now, the operation of the response data generating circuit 19 and CR circuit 11 will be described in greater detail. The description will first be made in connection with a case when the keyboard split mode is not set. In this case, the signal SP fed to the NOR gate 59 in FIG. 9 is "0". When a key is depressed, the key switch K1A (K2A) is turned on while the key switch K1B (K2B) remains "off", bringing about the second status as noted above. When the key is depressed, the output of the key switch K1A (K2A) is affected by chattering as shown in FIG. 13.

Then a "1" pulse is produced as signal DS immediately before the instant of switching of the first and second half timings, at which time the signals KC1 and KC2 are inverted to "1" and "0", respectively as shown in FIG. 10. At this time, the output of the NAND gate 36 in the key block of the operated key temporarily goes to "0" in synchronism to the appearance of the signal DS of "1". Also, with the appearance of the signal DS of "1" the output of the AND gate 41 goes to "1" since the normal output of the latch L3 is "1". As a result, the output of the NOR gate 44 fed to the NAND gate 52 goes to "0". Since the output of "0" is fed from the latch L1 to the other input terminal of the NAND gate 52, the output thereof fed to the NAND gate 38 goes to "1". The output of the NAND gate 38, which is fed to the 1st bit of the latch L1, thus goes to "1". Subsequently, signal LO1 of "1" is fed to the control section for the channel period allotted to the operated key. With the signal LO1 of "1", the latch L3 provides an output of "0".

Meanwhile, in the CR circuit 11 and CR control section 29 the flip-flops 78-1 to 78-8 have been reset by the reset signal RS provided with the closure of the power switch. With the closure of the key switch K1A (K2A) the CPU 1 provides signal ID of "1". If the timing signal $\phi$t1 (for channel 1, for instance) is allotted to the operated key, data "1" is set in the latch 85-1 at this time. Thus, the transfer gates 88-1 and 87-1 come up with the enabled and disabled states, respectively, to start discharging of the CR charge/discharge circuit 11-1.

At the same time, data indicative of the number of the CR charge/discharge circuit 11-1 is set in the circulating circuit of this key block, consisting of the shift registers 65-1 to 65-3 and gate group 63, at the timing of the channel 1. This data is subsequently circulated until a new key depression.

With the signal LO1 of "1" provided in response to the key operation noted above, the key data of the pertinent key block is provided from the gate group 72 enabled at the allotted channel timing to be latched in the latch 26. The latched data is fed to the CPU 1 through the gate circuit G2, which is now held enabled by control signal C2 of "1", thus starting the generation of a tone signal according to the key data.

While the key switch K1B (K2B) is "off" although the key switch K1A (K2A) has been turned on in the above way, the output of the AND gate 41 is "0" for the output of the latch L2 is "0". Also, the output of the AND gate 46 is "0" for the reset signal X and signal LO2 are both "0". Hence, the output of the NOR gate 44 goes to "1". With its two inputs of "1" the NAND gate 52 provides output of "0", and the AND gate 38 provide output of "1". Data "1" is thus continually fed to the latch L1, so that the output thereof is held to be "1". The output of the NAND gate 36 is "1" during this time because of the signal DS of "0". However, it may go to "1" due to chattering.

Subsequently, when the key switches K1A (K2A) and K1B (K2B) are both "on", the output of the NAND gate 35 goes to "1" with appearance of signal DS of "1". Meanwhile, the outputs of the AND gates 42 and 47 are both "0" for the output of the latch L3 and reset signal Y are both "0". Thus, with output of "1" from the NOR gate 45 and output of "0" from the latch L2 the output of the NAND gate 56 goes to "1", and the output of the NAND gate 37 goes to "1" which is set in the latch L2. Therefore, at the channel timing of this key the signal LO2 is "1", which is fed to the shift register 49 and A/D converter 26. Also, with the signals LO1 and LO2 of both "1" the signal ID goes to "0". This signal of "0" is subsequently held latched in the latch 85-1.

The signal LO2 of "1" is also latched in the latch 79-1 of the control circuit 75-1 in the CR control section 29 with the appearance of the timing signal $\phi$t1. The output of the latch 79-1 thus goes to "1" to set the flip-flop 78-1, inverting the set output thereof to "1", which is fed to the transfer gate 82-1 and NOR gates 83-1 and 84-1. Subsequently, with the appearance of the data CN designating the number of the CR charge/discharge circuit 11-1, the transfer gate 82-1 is enabled to invert the signal ADE to "1" which is fed to the control section 30.

The outputs of the NOR gates 83-1 and 84-1 also both go to "0" to disable both the transfer gates 87-1 and 88-1, so that the dicharging operation of the CR charge/discharge circuit 11-1 is stopped.

After both the key switches K1A (K2A) and K1B (K2B) subsequently have been "on", the outputs of the AND gates 42 and 47 remain "0" to hold the output of the NOR gate 45 to be "1". Thus, the NAND gate 56 provides output of "0" with the output of "1" from the latch L2, and the NAND gate 37 provides output of "1". Date "1" thus remains set in the latch L2. During this time, the output of the NAND gate 35 may go to "1" due to chattering.

With the inversion of the output of the latch L2 to "1", the signal N of the key blocks KB31 to KB38 also goes to "1", which is fed as data N1 to N8 through the gate groups 24-1 and 24-2 to the latch 25. In the instant case, however, the keyboard split mode is not set, so that the control signal C1 is "0", having the gate G1 disabled. Therefore, the signal N is rendered ineffective.

When the discharging of the CR charge/discharge circuit 11-1 is stopped with the key switches k1A (K2A) and K1B (K2B) both "on", the A/D converter 28 reads out the value of charge in the CR charge/discharge circuit 11-1 and converts it into digital data fed to the latch 27. At this time, the signal C3 goes to "1" to enable the gate G1. The output of the CR charge/discharge circuit 11-1 thus is fed through the gate G3 to the CPU 11, so that a touch response corresponding to the key depression speed is provided to the generated tone.

Subsequently, the control section 30 provides signal ADER of "1" according to software processing in the CPU 1. The output of the AND gate 76-1 thus goes to "1" to reset the flip-flop 78-1. The signal ADE thus goes to "0". Also, the NAND gates 83-1 and 84-1 come up with their outputs of "1" and "0", respectively, so that the transfer gates 87-1 and 881 are enabled and disabled, respectively (FIG. 9) to start charging of the CR charge/discharge circuit 11-1.

After the key switches K1A (K2A) and K1B (K2B) have been both "on", the charge value of the CR charge/discharge circuit 11-1 has been read out and the signal ADE has been inverted to "0", the output of the AND gate 41 is "0" since the output of the latch L3 is "0". In this state of the CPU 1 signal X therefrom is "1", so that the output of the AND gate 46 goes to "1" whenever the channel timing of its own key occurs. With the output of "1" provided from the AND gate 46 the output of the NOR gate 44 goes to "0", and with its inputs of "0" and "1" the output of the NAND gate 52 goes to "1", which is fed to the NAND gate 38.

Since the signal of "1" noted above is fed as one input to the NAND gate 38, the output thereof is inverted according to the output of the NAND gate 36 constituting the other input, i.e., the output of the NAND gate 38 goes to "1" when the NAND gate 36 provides output of "0" and it goes to "0" when the output of the NAND gate 36 goes to "1". The output of the NAND gate 36 is "1" when the output of the key switch K1A (K2A) is "0" (i.e., when the key switch is "off") and is "0" along with the basic clock DS when the key switch output is "1" (i.e., when the key switch is "on"). In other words, when the key switch K1A (K2A) is turned off, the signal L1 (LO1) goes to "0", and when the key switch K1A (K2A) is turned on, the signal L1 (LO1) goes to "1".That is, the output of the latch L1, i.e., signal LO1, follows the on/off state of the key switch K1A (K2A) (see FIG. 13). Therefore, when chattering of the key switch K1A (K2A) occurs, it is immediately reflected on the signal LO1, and the signal LO1 is changed according to the signal ID. This means that with the occurrence of chattering the CR charge/discharge circuit 11-1 repeats alternate charging and discharging operations as shown in FIG. 13. With a chattering, however, the "0" level of the signal LO1 is produced for very short periods of time, i.e., the discharging operation occurs for very short periods of time. Therefore, the output level of the CR charge/discharge circuit 11-1 never reaches the level corresponding to the perfectly discharged state (i.e., END voltage) but merely changes slightly in the neighborhood of the maximum voltage level. For this reason, after its charge value has been digitally converted to provide the touch response data, the CR charge/discharge circuit 11-1 is utilized for preventing chattering during the "on" period of the key switch K1A (K2A). This is one feature of the invention.

With subsequent key releasing operation, the key switch K1B (K2B) is turned off so that the output thereof goes to "0". However, the latch L2 remains in the set state, so that the outpput (L2) thereof and signal LO2 both remain "1". The rest of the circuit also remains in the same state as before the opening of the key switch K1B (K2B).

When the key switch K1A (K2A) is subsequently turned off, the signal LO1 is brought to the perfect "0" level at the end of chattering. This is so because the operation of the latch L1 (i.e., the state of signal LO1) follows the state of the key switch K1A (K2A). Thus, with the signal LO1 of "0" on signal LO2 of "1" the signal ID is fixed to "1" level. With the output of "0" from the NOR gate 83-1 and output of "1" from the NOR gate 84-1 the transfer gates 87-1 and 88-1 are enabled and disabled, respectively. Therefore, the discharging operation of the CR charge/discharge circuit 11-1 only is executed.

When the output of the CR charge/discharge circuit 11-1 becomes lower than the voltage END noted above, the signal Y goes to "1", which is fed to the AND gate 47. The output of the AND gate 47 thus goes to "1" at the channel timing for the operated key, thus inverting the output of the NOR gate 45 to "0". Thus, the NAND gate 56 provide output of "1" while the output of the NAND gate 37 is "0" since the output of the NAND gate 35 has been inverted to "1" with the opening of the key switch K1A (K2B). The latch L2 is thus reset to provide output "0". The signal LO2 is thus inverted to "0" by the CPU 1.

Meanwhile, with the appearance of the output of "1" from the AND gate 47 at the channel timing noted above, the output of the AND gate 51 goes to "0" to invert the output of the NAND gate 43 to "1", thus setting the latch L3. That is, the latch L3 now provides output of "1" to recover the initial state, i.e., the normal state before the key depression.

The operation described above takes place when the keyboard split mode is not set, i.e., when the key blocks KB1 to KB30 shown in FIG. 6 are operable for performing melody. While in the above operation the gate G1 (FIG. 7) is disabled by the control signal C1 of "0", it is possible that the signals LT1 and LT2, and further the signals KC3 and KC4, be "0" to this end. Hence in the key blocks KB1 to KB38 the output of the latch 25 has no effect on the generation of the tone of the operated key. When the keyboard split switch is turned on, the keyboard split signal is provided as "1" signal. This signal SP is irrelevant to the key blocks KB1 to KB30 as seen from FIG. 6, so that the transfer gates 72-1 to 72-7 of the gate group 72 in these key blocks remain enabled. Therefore, key data of an operated key in any of the key blocks KB1 to KB30 is latched in the latch 26 while the gate G2 is enagled by the control signal C2 which is provided as "1" signal, so that the key data is transferred to the CPU 1 for the generation of the tone signal. That is, the melody tone of the data is sounded.

Since the electronic musical instrument of this embodiment is an 8-tone polyphonic instrument, up to 8 tones can be simultaneously produced from the key blocks KB1 to KB30. That is, the output from a key in any of the key blocks KB31 to KB38, which serve as accompaniment key blocks in this case, is fed to the accompaniment sound source, while 8 keys which can be operated simultaneously for producing the corresponding number of simultaneous different tones are allotted to the key blocks KB1 to KB30 as melody key blocks for the melody sound source.

Meanwhile, when the keyboard split mode is not set, up to 8 simultaneous different tones may be produced with the key blocks KB1 to KB31, all of which this time serve as melody key blocks. It should be understood that the same maximum number of different melody tones can be simultaneously produced when the the keyboard split mode is set and also when the mode is not set, which is a feature of the invention.

When the circuit shown in FIG. 8 is one of the accompaniment key blocks KB31 to KB38, i.e., in the keyboard split mode, the keyboard split signal SP of "1" is fed to the NOR gate 59, so that the output thereof is held "0" during this mode. The output of the inverter 64 is also held "1" so that the AND gate 48 provides output of "0" to have the transfer gates 72-1 to 72-2 of the gate group 72 disabled. Key data thus is latched as 7-bit all "0" data in the latch 26. The CPU 1 judges this all "0" data as ineffective data.

Further, in the case of the accompaniment key blocks KB31 to KB38 the signal N (i.e., N1 to N8) as the output of the latch L2 is fed to the latch 25. The data N1 to N8 are fed to the latch 25 through the gate groups 24-1 and 24-2 which are enabled by the respective signals KC3 and KC4 of "1" level. Also, the signals LT1 and LT2, which are "1" along with the respective signals KC3 and KC4 in the first and second half periods, respectively, are fed to the latch 25. The data N1 to N8 is thus latched as two consequtive 4-bit data N1 to N4 and N5 to N8 in the respective first and second half periods in the latch 25. Since in this case the control signal C1 is provided as "1" signal, the gate G1 is held enabled, so that the data N1 to N4 and N5 to N8 are consequtively fed to the CPU 1 and processed as key data of an accompaniment key. At this time, the CPU 1 executes accompaniment processes featuring the keyboard split mode according to the key data of the accompaniment key, e.g., drives the accompaniment sound source to provide a timbre different from that of tone produced from any melody key in the key blocks KB1 to KB30 or start autoaccompaniment of a given rhythm. At this time, data "0" is not set in the latch L3 (FIG. 8) in the key blocks KB30 to KB38 so that the CR circuit 11 is not used. Therefore, the touch response function is not provided for the accompaniment.

Figure 14:
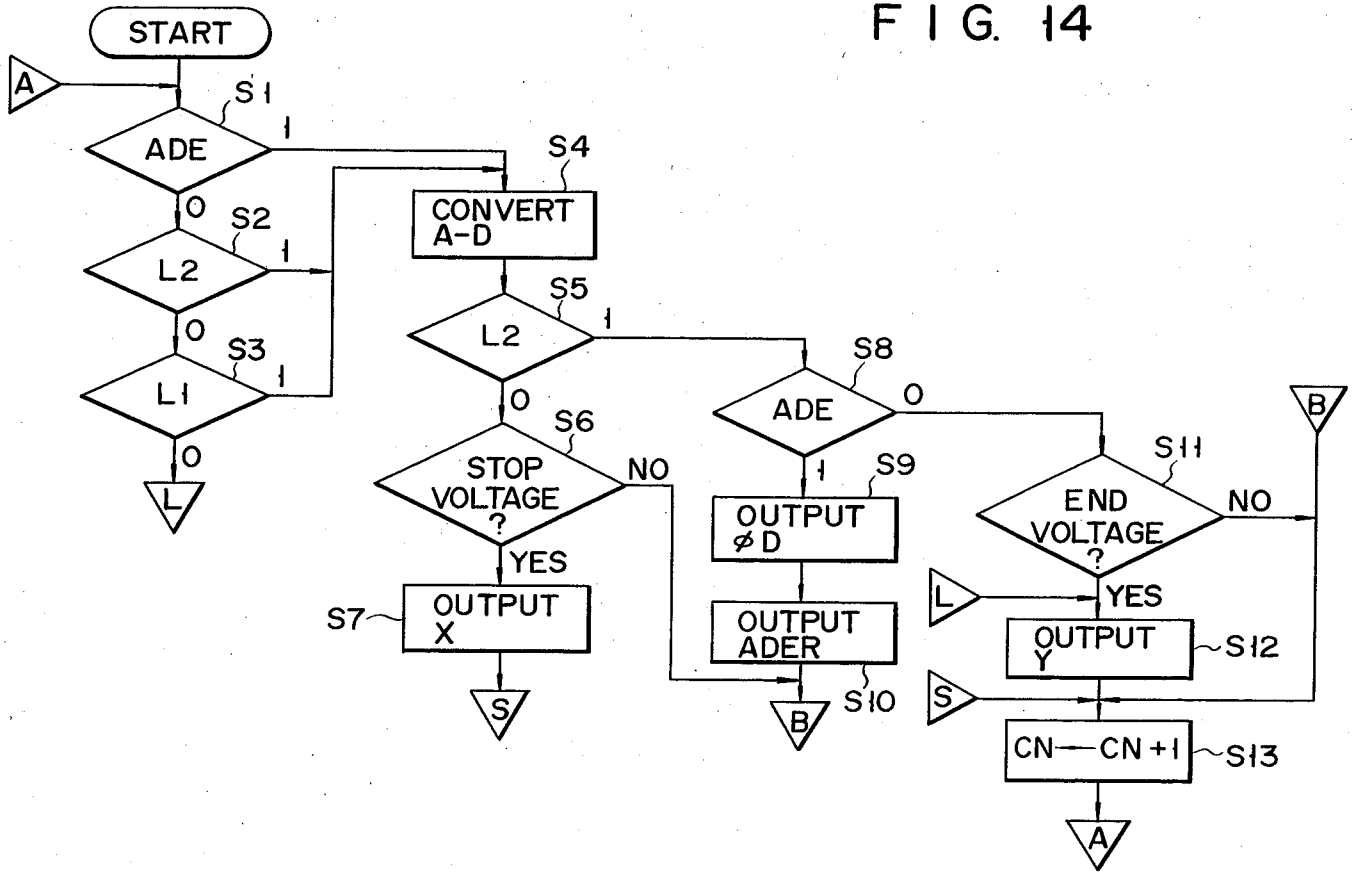
FIG. 14 is a flow chart for explaining a function of a control section shown in FIG. 9.

FIG. 14 is a flow chart for explaining the operation of a main part of the control section 30. Detailed description of the individual steps is not given. In case of the normal key operation, steps S1, S2, S3, S4, S5 and S6 are executed before the appearance of the signal ADE of "1" with the closure of the key switch K1B (K2B) subsequent to the closure of the switch K1A (K2A). The routine then goes to a step S11, in which the CR number designation data is incremented for the process of the next one of the CR charge/discharge circuits 11-1 to 11-8 of the CR circuit 11. The routine then goes back to the step S1. When the key switch K1A (K2A) is turned on while the key switch K1B (K2B) is "off", the step S6 produces a decision "YES". The routine thus goes to a step S7, in which the signal X goes to "1".

When the key switch K1B (K2B) is subsequently turned on as well, the signal ADE goes to "1", so that steps S1, S4, S5, S8, S9, S10 and S13 are executed, and the routine then goes back to the step S1.

Subsequently, in the neighborhood of the instant of the opening of the key switch K1B (K2B) with the key releasing operation, the signal ADE is inverted to "0", so that the steps S1, S2, S4, S5, S8, S11 and S13 are executed. The routine then goes back to the step S1.

When the key switch K1A (K2A) is also turned off, the discharge of the CR charge/discharge circuit proceeds. When a step S11 provides a decision "YES", a step S12 is executed, in which the signal Y is inverted to "1" level, thus causing the inversion of the signal L2 (LO2) to "0" level. The routine then goes back through a step S13 to the step S1, thus bringing an end to the process with respect to the key operation of this time. It is now ready for the next key operation.

As has been described in the foregoing, with the above embodiment of the electronic musical instrument with touch response function the key depression speed is detected by the switch having first and second switches and the charge/discharge circuit is operated according to the result of detection for converting the output thereof to obtain a tone signal with a touch response, while after the A/D conversion of the key depression speed signal the operation of the charge/discharge circuit is synchronized to the on/off state of the key. Therefore, the charge/discharge circuit which is provided for the purpose of providing a touch response, can also serve to eliminate adverse effect of the chattering of the key. Thus, it is possible to obtain improved quality of tones with a simple overall circuit.

Further, since the charge/discharge circuits are provided in number substantially corresponding to the number of tone generation channels and the charge/discharge circuits that are used for providing touch response to the generated tone signals are stored for the individual keys, the process of allotting the channels to the charge/discharge circuits can be simplified.

Further, keyboard split means is provided to split the keyboard into a plurality of key groups such that the same number of different tones can be simultaneously produced from a key group, to which a touch response is provided, when the keyboard split mode is set and also when the mode is not set. It is thus possible to overcome the inconvenience that is fled with the prior art instrument in that the maximum number of melody tones that can be produced simultaneously when the keyboard split mode is set is different from that when the mode is not set.

Further, while in the above embodiment the two opposite phase key common signals KC1 and KC2 have been used, it is also possible to use other signals KC3, KC4, . . . , as well such that these signals are consequtively set to "1" and converted for each signal to first and second voltage levels supplied to the first and second key switches. In this case, the outputs of the first and second key switches are commonly coupled for three or more keys.

Further, the multi-input logic circuits in the above embodiment can be implemented as a semiconductor integrated circuit to facilitate mounting. Furthermore, the resistors R1 to R38 are less subject to fluctuations. Moreover, the common connection of the output terminals of the first and second key switches of a plurality of keys reduces the number of output pins, which is desired from the standpoint of the implementation as a semiconductor integrated circuit.

As has been shown, with the electronic musical instrument with touch response function, which comprises a keyboard consisting of a plurality of keys each having first and second keys operable at different timings, means for providing a train of predetermined level signals, means for converting these signals into first and second voltage levels and supplying these voltages to the first and second key switches, and means for generating a tone with a touch response according to the output signals of the first and second key switches, the accuracy of the key depression speed data is greatly improved, and a touch response of a very satisfactory response characteristic can be obtained. In addition, the multi-input logic operation that is performed in the conversion of the train of predetermined level signals into the first and second voltage levels, promotes the improvement of the accuracy of the key depression speed data.

What is claimed is:

1. An electronic musical instrument with touch response function comprising:

a keyboard with a plurality of keys each having first and second key switches operable at different timings;

means for supplying first and second voltage signals at different voltage levels to said first and second key switches, respectively;

means for obtaining first and second key output signals based on said first and second voltage signals from said first and second key switches; and means for generating a tone signal with a touch response provided according to said first and second key output signals.

2. The electronic musical instrument according to claim 1, wherein said voltage signal supplying means includes:

means for generating first and second key common signals of opposite polarities;

level conversion means for forming voltage signals having first and second levels from said first and second key common signals; and means for distributing the voltage signals thus obtained to the first and second key switches of the plurality of keys.

3. The electronic musical instrument according to claim 1, wherein said key output signal obtaining means includes:

a multi-input logic circuit having a resistor having one terminal, to which said first and second key output signals are commonly fed, and another terminal, to which a predetermined voltage is applied, and first and second buffer circuits having respective input terminals commonly connected to one terminal of said resistor and having different input threshold levels.

4. The electronic musical instrument according to claim 2, wherein said distributing means includes a plurality of diodes connected between said level conversion means and said key switches.

5. The electronic musical instrument according to claim 1, wherein said tone signal generating means includes means for forming response data having a content based on said first and second key output signals.

6. The electronic musical instrument according to claim 5, wherein said response data forming means includes:

charge/discharge circuit means; and means for forming a voltage corresponding to a time interval, which is provided between consecutive operations of said first and second key switches by said charge/discharge circuit means in response to a key operation.

7. The electronic musical instrument according to claim 5, wherein said response data forming means includes:

key depression detecting means connected to said first and second key switches, for detecting the depression of a key on the keyboard;

charge/discharge circuit means;

means for controlling the charge/discharge operation of said charge/discharge circuit means according to the on/off state of said first and second key switches;

key depression speed detecting means for detecting the difference between the "on" times of said first and second key switches corresponding to a key depression speed as a corresponding voltage obtained in said charge/discharge circuit means;

analog-to-digital converting means for converting the output of said key depression speed detecting means into digital data;

means for generating a tone signal according to an output of said analog-to-digital converting means and an output of said key depression speed detecting means; and means for synchronizing said key depression detecting means and key depression speed detecting means after the output of said key depression speed detecting means has been converted to the digital data by said analog-to-digital converting means.

8. The electronic musical instrument according to claim 3, which further comprises split means for splitting the keys on said keyboard into a first key group with a touch response function and a second key group without touch response function; and said tone generating means includes:

means for simultaneously producing a plurality of tone signals on a time division basis, and means for making the number of tone signals that is generated simultaneously from said first key group with said touch response function when the keys are split by said split means to be the same as the number of tones that is generated simultaneously when the keys are not split.

9. The electronic musical instrument according to claim 6, wherein said tone signal generating means has a plurality of tone generation channels for generating a plurality of simultaneous tone signals on a time division basis; and said charge/discharge circuit means includes:

charge/discharge circuits substantially corresponding in number to said plurality of tone generation channels; and means for storing number data representing charge/discharge circuits used at the time of formation of touch response data for each key.

* * * * *